US008272705B2

(12) United States Patent
Itogawa

(10) Patent No.: US 8,272,705 B2
(45) Date of Patent: Sep. 25, 2012

(54) LIQUID EJECTION APPARATUS AND NON-TRANSITORY STORAGE MEDIUM STORING PROGRAM

(75) Inventor: Yoshihiro Itogawa, Gifu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 253 days.

(21) Appl. No.: 12/835,218

(22) Filed: Jul. 13, 2010

(65) Prior Publication Data

US 2011/0050768 A1 Mar. 3, 2011

(30) Foreign Application Priority Data

Aug. 26, 2009 (JP) ..... 2009-195794

(51) Int. Cl.
*B41J 29/38* (2006.01)
*B41J 2/165* (2006.01)
*B41J 2/17* (2006.01)

(52) U.S. Cl. ..... 347/9; 347/35; 347/98

(58) Field of Classification Search ..... None
See application file for complete search history.

(56) References Cited

U.S. PATENT DOCUMENTS

| | | | | |
|---|---|---|---|---|
| 5,659,342 | A | 8/1997 | Lund et al. | |
| 5,903,288 | A * | 5/1999 | Yamaguchi | 347/24 |
| 6,598,965 | B1 | 7/2003 | Lund et al. | |
| 7,645,019 | B2 * | 1/2010 | Hirakawa | 347/21 |

FOREIGN PATENT DOCUMENTS

| | | |
|---|---|---|
| JP | 8-72231 | 3/1996 |
| JP | 8-112904 | 5/1996 |
| JP | 2001-205800 | 7/2001 |
| JP | 2005-225115 | 8/2005 |
| JP | A-2007-313665 | 12/2007 |
| JP | A-2009-166353 | 7/2009 |

OTHER PUBLICATIONS

Notification of Reason for Refusal dated Jun. 21, 2011 received from the Japanese Patent Office from related Japanese Application No. 2009-195794, together with an English-language translation.

* cited by examiner

*Primary Examiner* — Stephen Meier
*Assistant Examiner* — Tracey McMillion
(74) *Attorney, Agent, or Firm* — Scully, Scott, Murphy & Presser, PC

(57) ABSTRACT

A liquid ejection apparatus including: a flushing-operation-data producing section which produces flushing-operation data for flashing of ink; a second-liquid-ejection-data producing section which produces data about ejection of treatment liquid such that (i) the treatment liquid is to be landed on a dot area on which the ink is to be landed upon forming an image dot among dot areas and (ii) an amount of the treatment liquid landed to be on at least one dot area on which the ink is to be landed upon flashing of the ink is made smaller, by referring the flushing-operation data produced by the flushing-operation-data producing section, than an amount of the treatment liquid to be landed on a dot area on which the ink is not to be landed upon flashing; and a second-liquid controlling section which controls a head on the basis of the data produced by the second-liquid-ejection-data producing section.

22 Claims, 9 Drawing Sheets

FIG.6

| | | INK COLOR (WEIGHT) | | | |
|---|---|---|---|---|---|
| | | BLACK (1) | MAGENTA (2) | CYAN (3) | YELLOW (4) |
| INK AMOUNT (WEIGHT) | LARGE DROPLET(1) | 1 | 2 | 3 | 4 |
| | MEDIUM-SIZE DROPLET(2) | 2 | 4 | 6 | 8 |
| | SMALL DROPLET(3) | 3 | 6 | 9 | 12 |

AREA ON WHICH TREATMENT LIQUID IS TO BE LANDED

AREA ON WHICH IMAGE DOT IS TO BE FORMED

AREA ON WHICH IMAGE DOT IS TO BE FORMED AND TREATMENT LIQUID IS TO BE LANDED

AREA ON WHICH IMAGE DOT AND FLUSHING DOT ARE TO BE FORMED

AREA ON WHICH FLUSHING DOT IS TO BE FORMED

LIQUID EJECTION APPARATUS AND NON-TRANSITORY STORAGE MEDIUM STORING PROGRAM

CROSS REFERENCE TO RELATED APPLICATION

The present application claims priority from Japanese Patent Application No. 2009-195794, which was filed on Aug. 26, 2009, the disclosure of which is herein incorporated by reference in its entirety.

BACKGROUND OF THE INVENTION

1. Field of the Invention

The present invention relates to a liquid ejection apparatus including (a) a recording head configured to form image dots and flushing dots on a recording medium by ejecting ink droplets onto the recording medium and (b) a treatment-liquid ejection head configured to eject droplets of the treatment liquid.

2. Description of the Related Art

In general, an ink-jet printer including an ink-jet head configured to eject ink droplets from a plurality of liquid-ejection openings performs a preliminary ejection (i.e., flushing) for ejecting ink whose viscosity has been increased, in addition to a normal ejection for ejecting the ink droplets to form an image, in order to prevent clogging in the liquid-ejection openings which caused by the ink solidified in or near the liquid-ejection openings. In a conventional printer, the preliminary ejection is performed in parallel with the image forming, and flushing dots are formed on the recording medium by the ink ejected upon the preliminary ejection. In this conventional printer, the ink droplets are ejected in the preliminary ejection onto a background or a black area of the image formed on the recording medium, thereby making the flushing dots inconspicuous.

Further, there is known another conventional ink-jet printer configured to apply treatment liquid on a recording medium in order to prevent spreading of a dot formed by ink ejected on the recording medium and to sharpen the dot.

SUMMARY OF THE INVENTION

However, in the printer using the treatment liquid as described above, there is a risk that the treatment liquid sharpens not only the dot for forming the image but also the flushing dot formed by the ink ejected in the preliminary ejection. As a result, there may be caused a problem that the flushing dot is easily recognized by a viewer and the image is degraded.

This invention has been developed in view of the above-described situations, and it is an object of the present invention to provide a liquid ejection apparatus which makes a flushing dot inconspicuous.

The object indicated above may be achieved according to the present invention which provides a liquid ejection apparatus comprising: a feeding mechanism configured to feed a recording medium in a feeding direction; a first ejection head having a first liquid-ejection opening through which is ejected first liquid that is for forming an image on the recording medium; a second ejection head having a second liquid-ejection opening through which is ejected second liquid that is liquid to be ejected on the recording medium to reduce a degree of absorption of the first liquid into the recording medium; an image-data storage section configured to store image data of the image to be recorded on the recording medium; an image-recording controlling section configured to control the first ejection head on the basis of the image data stored in the image-data storage section such that an image dot is to be formed on the recording medium by the first liquid ejected from the first liquid-ejection opening of the first ejection head and landed on the recording medium; a flushing-operation-data producing section configured to produce flushing-operation data for a flushing operation of the first liquid; a flushing-operation controlling section configured to control the first ejection head on the basis of the flushing-operation data produced by the flushing-operation-data producing section such that the flushing dot is to be formed on the recording medium by the first liquid ejected from the first liquid-ejection opening of the first ejection head and landed on the recording medium; a second-liquid-ejection-data producing section configured to produce data about the ejection of the second liquid such that (i) the second liquid is to be landed on at least one dot area on which the first liquid is to be landed on the basis of the control of the image-recording controlling section among a plurality of dot areas into which the recording medium is partitioned and each of which has a first length corresponding to a resolution in a direction perpendicular to the feeding direction and a second length corresponding to a resolution in a direction parallel to the feeding direction and (ii) an amount of the second liquid to be landed on at least one dot area on which the first liquid is to be landed on the basis of the control of the flushing-operation controlling section is made smaller, by referring the flushing-operation data produced by the flushing-operation-data producing section, than an amount of the second liquid to be landed on a dot area on which the first liquid is not to be landed on the basis of the control of the flushing-operation controlling section; and a second-liquid controlling section configured to control the second ejection head on the basis of the data produced by the second-liquid-ejection-data producing section.

The object indicated above may also be achieved according to the present invention which provides a non-transitory storage medium storing a program used for a liquid ejection apparatus, the liquid ejection apparatus comprising: a feeding mechanism configured to feed a recording medium in a feeding direction; a first ejection head having a first liquid-ejection opening through which is ejected first liquid that is for forming an image on the recording medium; a second ejection head having a second liquid-ejection opening through which is ejected second liquid that is liquid to be ejected on the recording medium to reduce a degree of absorption of the first liquid into the recording medium; and an image-data storage section configured to store image data of the image to be recorded on the recording medium, wherein the program comprises: controlling the first ejection head on the basis of the image data stored in the image-data storage section such that an image dot is to be formed on the recording medium by the first liquid ejected from the first liquid-ejection opening of the first ejection head and landed on the recording medium; producing flushing-operation data based on which a flushing operation of the first liquid; producing data about the ejection of the second liquid such that (i) the second liquid is to be landed on at least one dot area on which the first liquid is to be landed on the basis of the image data among a plurality of dot areas into which the recording medium is partitioned and each of which has a first length corresponding to a resolution in a direction perpendicular to the feeding direction and a second length corresponding to a resolution in a direction parallel to the feeding direction and (ii) an amount of the second liquid to be landed on at least one dot area on which the first liquid is to be landed on the basis of the flushing-operation data is made smaller, by referring the produced flushing-operation data, than an amount of the second liquid to be landed on a dot area on which the first liquid is not to be landed on the basis of the flushing-operation data; controlling the first ejection head on the basis of the produced flushing-operation data such that the flushing dot is to be formed on the recording medium by the first liquid ejected from the first liquid-ejection opening of the first ejection head and landed on the recording medium; and controlling the second ejection head on the basis of the produced data about the ejection of the second liquid.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIG. 5 is a block diagram showing functions of a controller shown in

FIG. 1;

FIG. 6 is a table representing a relationship between (a) a color and an amount of ink ejected from liquid-ejection openings of a recording head shown in FIG. 1 and (b) brightness of a dot formed by the ejection;

DESCRIPTION OF THE EMBODIMENT

Hereinafter, there will be described an embodiment of the present invention by reference to the drawings.

Figure 1:
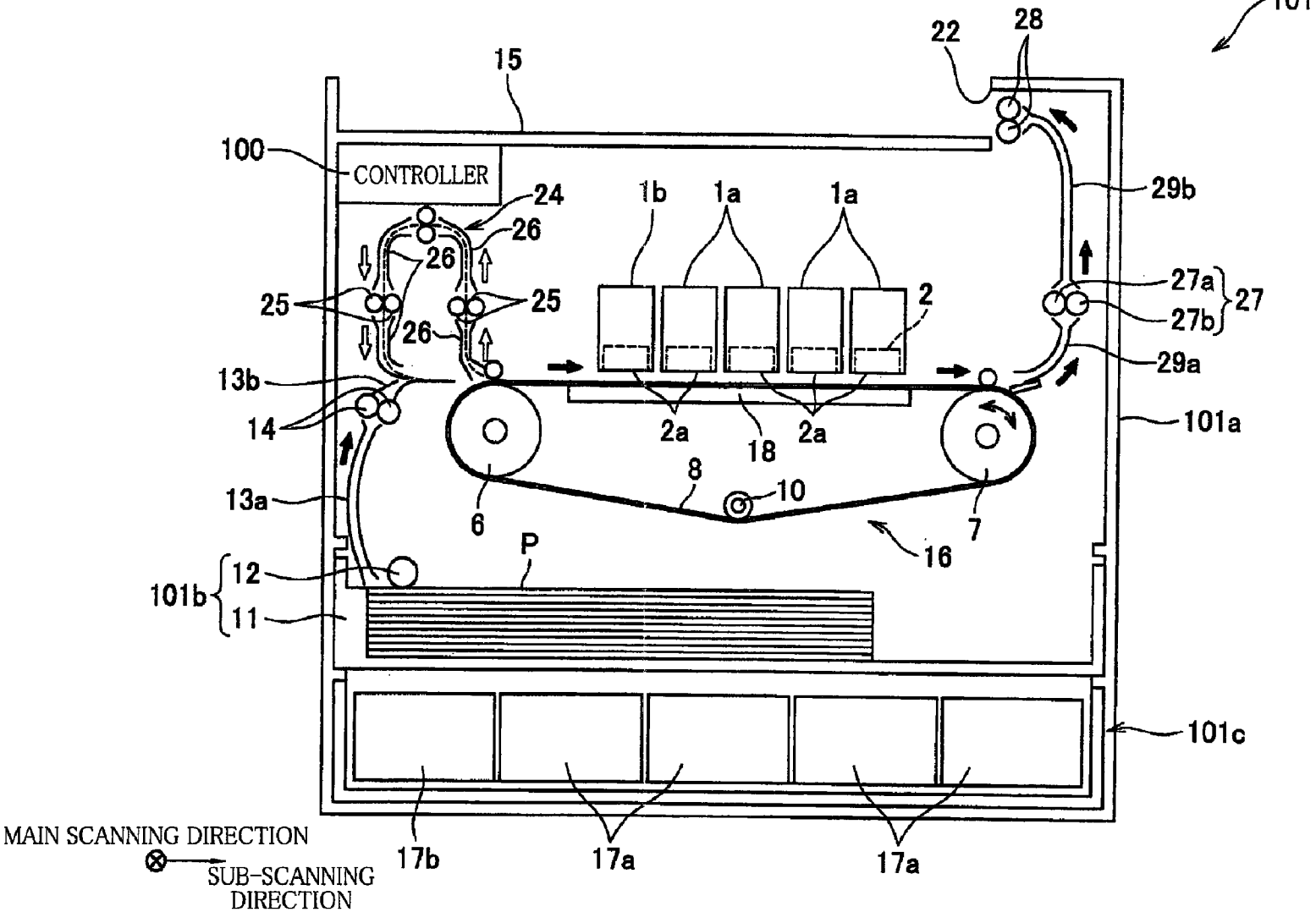
FIG. 1 is a side view generally showing an entire construction of an ink-jet printer as an embodiment of the present invention.

As shown in FIG. 1, an ink jet printer 101 as a present embodiment includes a casing 101*a* having a rectangular parallelepiped shape. In the casing 101*a*, there are provided (a) a sheet feeding mechanism 16 configured to feed a sheet P as a recording medium in a forward sheet feeding direction which is a rightward direction in FIG. 1 or in a reverse sheet feeding direction which is opposite or reverse to the forward sheet feeding direction and (b) four recording heads 1*a* as first ejection heads and a treatment-liquid ejection head 1*b* as a second ejection head disposed on an upper side of the sheet feeding mechanism 16. The four recording heads 1*a* respectively eject ink (first liquid) of four colors, namely, cyan, magenta, yellow, and black, onto the sheet P fed in the forward sheet feeding direction by the sheet feeding mechanism 16 (that is, the forward sheet feeding direction is a direction in which the sheet P is fed when the is formed). The treatment-liquid ejection head 1*b* is located on an upstream side of the four recording heads 1*a* in the forward sheet feeding direction and configured to eject treatment liquid (second liquid) onto the sheet P fed in the forward sheet feeding direction by the sheet feeding mechanism 16. It is noted that, in the following explanation, each of the heads 1*a* and 1*b* may be simply referred to as a "head 1" without distinction because the recording heads 1*a* and the treatment-liquid ejection head 1*b* have generally the same structure. It is further noted that, in the present embodiment, the upstream side of the recording heads 1*a* on which the treatment-liquid ejection head 1*b* is disposed is a side which is the same as a downstream side of the recording heads 1*a* in a direction in which the recording heads 1*a* are moved relative to the sheet P, i.e., a leftward direction in FIG. 1.

The treatment liquid used in the present embodiment is colorless transparent liquid which causes an action by being mixed with ink. This treatment liquid is applied or coated on the sheet P in advance to reduce a degree of permeation of the ink landed or attached later. As a result, the ink can be easily fixed on the sheet P. Thus, it is possible to restrain that an outline of an edge of a dot formed on the sheet P becomes blurred by diffusion of the ink ejected from the recording head 1*a* and absorbed into the sheet P and also possible to restrain that the ink of different colors is spread or smeared by being mixed with each other on the sheet P. In the present embodiment, the treatment liquid containing polyvalent metal salt is used as an acting agent. When the ink is landed on the sheet P coated or covered in advance with the treatment liquid, dyes or pigments of the ink as a coloring agent react with a polyvalent metal ion to form a metal complex insoluble or hardly soluble in water. Accordingly, the ink is less permeated into the sheet P.

On a top plate of the casing 101*a* is provided a sheet-discharge portion 15 onto which an image-recorded sheet P is discharged. A sheet-supply unit 101*b* is disposed below the sheet feeding mechanism 16, and a tank unit 101*c* is disposed below the sheet-supply unit 101*b*. Four ink tanks 17*a* and a treatment-liquid tank 17*b* are accommodated in the tank unit 101*c*. On an upstream side of the treatment-liquid ejection head 1*b* in the forward sheet feeding direction, there is disposed a two-side recording mechanism 24 configured to turn upside down a sheet P on one side of which has been recorded the image, where image recording is performed on both sides of the sheet P, that is, two side recording is performed.

A sheet-feed path is formed in the ink jet printer 101 so as to extend in a direction indicated by black bold arrow. The sheet P is fed through this sheet-feed path from the sheet-supply unit 101*b* toward the sheet-discharge portion 15. The sheet-supply unit 101*b* includes a sheet-supply tray 11 and a sheet-supply roller 12. The sheet-supply tray 11 has a box shape opening upward. A plurality of sheets P are accommodated in the sheet-supply tray 11 in a state in which the sheets P are stacked one another. The sheet-supply roller 12 supplies an uppermost one of the sheets P accommodated in the sheet-supply tray 11. The supplied sheet P is fed to the sheet feeding mechanism 16 while being guided by guides 13*a*, 13*b* and nipped by a pair of sheet-feed rollers 14.

The sheet feeding mechanism 16 includes two belt rollers 6, 7, a sheet-feed belt 8, a tension roller 10, and a platen 18. The sheet-feed belt 8 is an endless belt wound around the rollers 6, 7 so as to bridge the rollers 6, 7, and a tension is applied to this sheet-feed belt 8 by the tension roller 10. The platen 18 is disposed at an area inside the sheet-feed belt 8 so as to support the sheet-feed belt 8 at a position facing the recording heads 1*a* and the treatment-liquid ejection head 1*b*. The belt roller 7 is a drive roller which is driven to be rotated by a motor, not shown, in a clockwise direction or the counterclockwise direction in FIG. 1, and the belt roller 6 is a driven roller which is rotated in accordance with a circulation of the sheet-feed belt 8 caused by the rotation of the belt roller 7. Accordingly, switching of the drive of the motor for driving the belt roller 7 allows the sheet feeding mechanism 16 to feed the sheet P placed on the sheet-feed belt 8 in the forward sheet feeding direction and the reverse sheet feeding direction.

The sheet P fed by the sheet feeding mechanism 16 in the forward sheet feeding direction is fed while being guided by a guide 29*a* and nipped by a pair of sheet-feed rollers 27. The pair of sheet-feed rollers 27 includes (a) a drive roller 27*a* configured to be driven to be rotated in the clockwise direction or the counterclockwise direction in FIG. 1 by a motor, not shown, rotatable forwardly and reversely, and (b) a driven roller 27*b* configured to be driven to be rotated in accordance with the rotation of the drive roller 27*a*. Thus, the pair of sheet-feed rollers 27 can feed, while nipping, the sheet P in the forward sheet feeding direction and the reverse sheet feeding direction.

The sheet P fed by the pair of sheet-feed rollers 27 in the forward sheet feeding direction is fed while being guided by a guide 29*b* and nipped by a pair of sheet-feed rollers 28, and then discharged onto the sheet-discharge portion 15 from a sheet-discharge opening 22 formed in an upper portion of the casing 101*a*. On the other hand, the sheet P fed by the pair of sheet-feed rollers 27 in the reverse sheet feeding direction is fed to the sheet feeding mechanism 16 again. In this case, the sheet feeding mechanism 16 is changed to a state for feeding the sheet P in the reverse sheet feeding direction by a control of a controller 100 which will be described below. Thus, the sheet P fed to the sheet feeding mechanism 16 is fed in the reverse sheet feeding direction to the two-side recording mechanism 24 at a position located on a downstream side of the treatment-liquid ejection head 1*b* in the reverse sheet feeding direction.

The two-side recording mechanism 24 is mainly constituted by a plurality of pairs of sheet-resupply rollers 25 and a plurality of guides 26 for guiding the sheet P fed in the two-side recording mechanism 24. The two-side recording mechanism 24 is configured to feed the sheet P along a sheet flipping path, indicated by white bold arrows in FIG. 1, whose two ends are connected to the sheet-feed path so as to form a loop. More specifically, in the two-side recording mechanism 24, the sheet P is fed through the sheet flipping path in a state in which one of faces of the sheet P that is a front face before the sheet is fed to the two-side recording mechanism 24 faces outward. Thus, the sheet P fed to the two-side recording mechanism 24 through the sheet-feed path in the reverse sheet feeding direction by the sheet feeding mechanism 16 is again fed to the sheet-feed path from a position between the sheet feeding mechanism 16 and the pair of sheet-feed rollers 14 in a state in which the sheet P is flipped over, that is, front and back faces of the sheet P are reversed to each other.

Each of the five heads 1 has a generally rectangular parallelepiped shape elongated in a main scanning direction in which each head is reciprocated. These heads 1 are fixed so as to be arranged in the sheet feeding direction. That is, this printer 101 is a line-type printer in which the sheet feeding direction and the main scanning direction are perpendicular to each other. It is noted that the four recording heads 1*a* are arranged in order of cyan, magenta, yellow, and black from the upstream side in the forward sheet feeding direction.

Each head 1 includes a head main body 2 in which a plurality of liquid-ejection openings 108 as first or second liquid-ejection openings (with reference to FIGS. 3 and 4) for ejecting the ink or the treatment liquid. Each of the four ink tanks 17*a* stores therein the ink of a corresponding one of the colors, and the treatment-liquid tank 17*b* stores therein the treatment liquid. The ink of cyan, magenta, yellow, and black, and the treatment liquid are respectively supplied from these ink tanks 17*a* and treatment-liquid tank 17*b* to the head main bodies 2.

The liquid-ejection openings 108 are opened in a liquid-ejection face 2*a*, i.e., a lower face, of each of the head main bodies 2. The ink or the treatment liquid supplied to the head main body 2 reaches the liquid-ejection openings 108. When the sheet P fed by the sheet feeding mechanism 16 in the forward sheet feeding direction passes through a position just under the five heads 1, the treatment liquid and the ink of the four colors are ejected in order onto an upper face of the sheet P from the liquid-ejection openings 108. As a result, a desired color image is formed on the upper face of the sheet P, i.e., one of the faces of the sheet P which faces upward on the sheet-feed belt 8.

Figure 2:
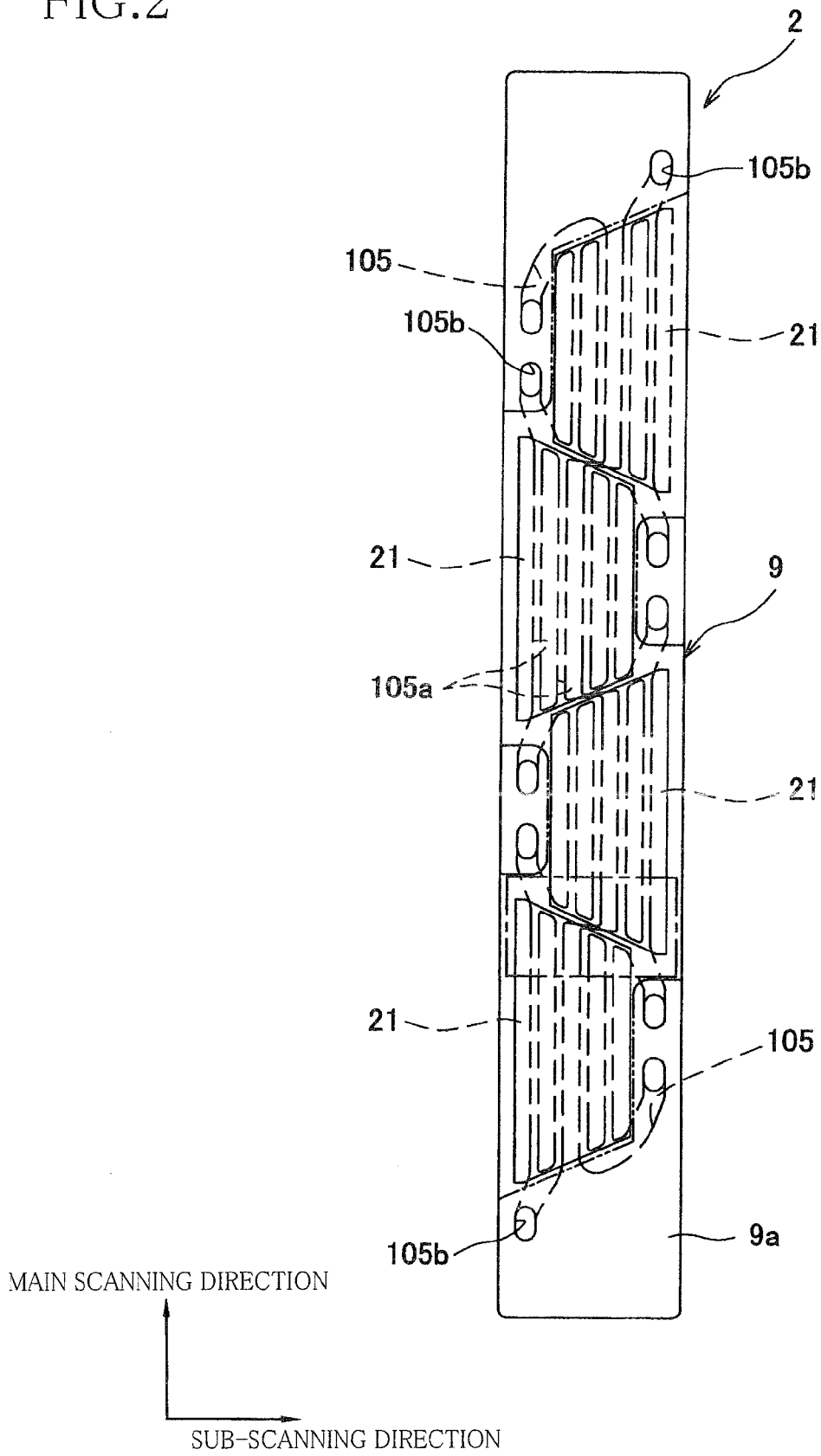
FIG. 2 is a plan view of a head main body shown in FIG. 1.
Figure 3:
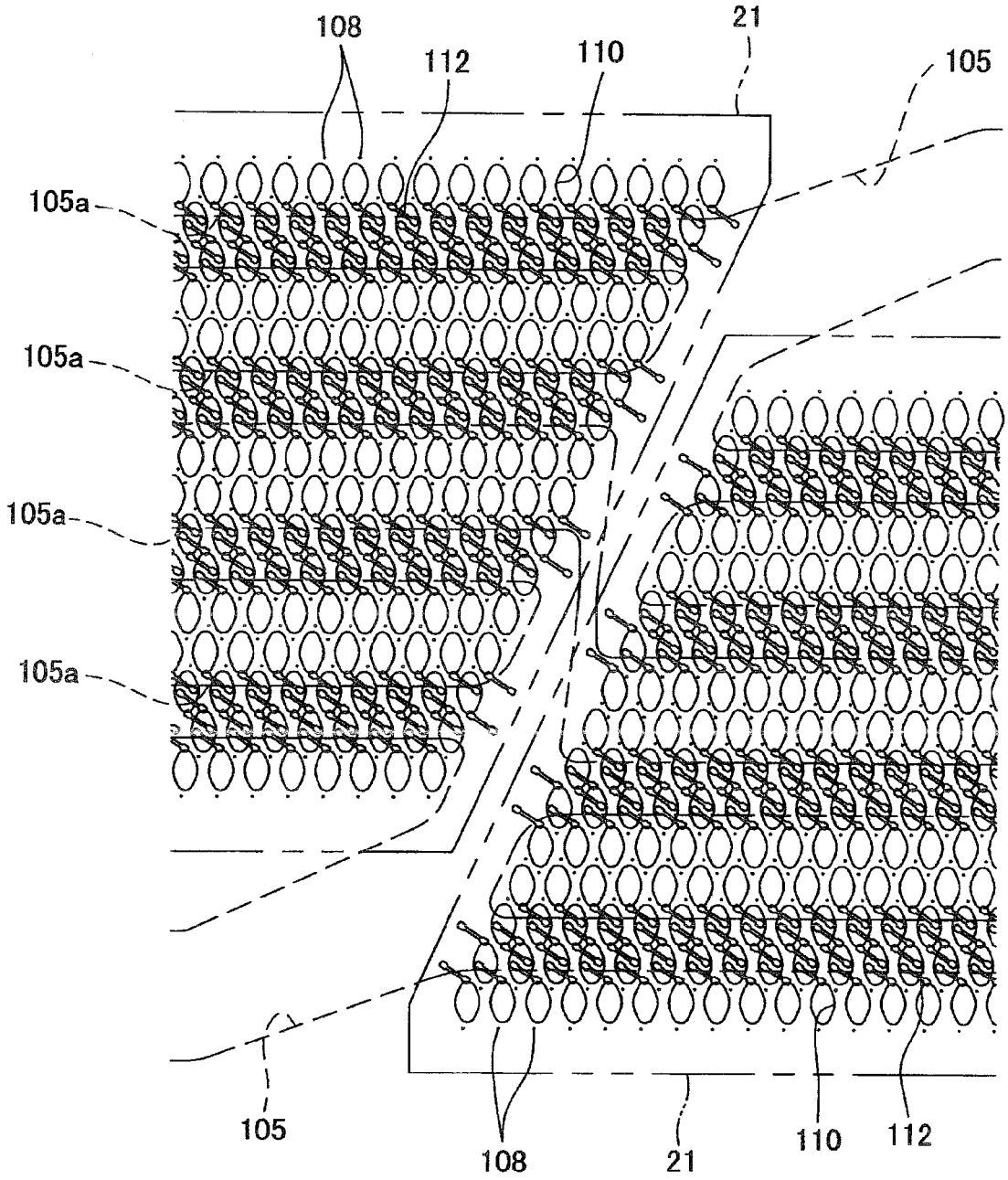
FIG. 3 is an enlarged view of an area enclosed with a one-dot chain line in FIG. 2.
Figure 4:
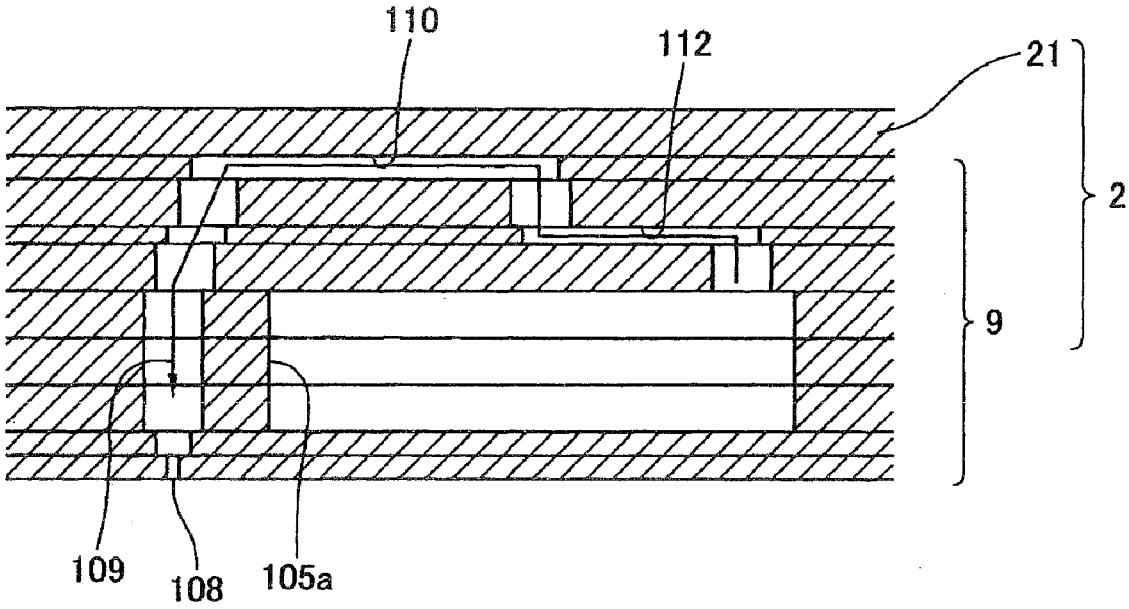
FIG. 4 is a cross-sectional view partially showing the head main body shown in FIG. 2.

There will be next explained the head main bodies 2 in detail with reference to FIGS. 2 to 4. It is noted that, in FIG. 3, pressure chambers 110, apertures 112, and the liquid-ejection openings 108 are illustrated by solid lines for easier understanding purposes though these elements are located under actuator units 21 and thus should be illustrated by broken lines.

As shown in FIG. 2, each head main body 2 is a stacked body in which the four actuator units 21 are fixed to an upper face 9*a* of a channel unit 9. It is noted that, though not shown, each of the recording heads 1*a* and the treatment-liquid ejection head 1*b* includes, in addition to the head main body 2, reservoir units for storing the ink or the treatment liquid supplied to the channel unit 9, a Flexible Printed Circuit (FPC) for supplying drive signals to the actuator units 21, a controlling board for controlling an driver IC mounted on the FPC, and so on.

As shown in FIG. 4, the channel unit 9 has a laminar structure in which a plurality of metal plates made of stainless steel are positioned to each other. In the channel unit 9, there are formed individual ink channels 109 extending from manifold channels 105 (with reference to FIGS. 2 and 3) to sub-manifold channels 105*a* and further extending from outlets of the respective sub-manifold channels 105*a* to the liquid-ejection openings 108 via the apertures 112 and the pressure chambers 110. Each of the actuator units 21 includes a plurality of actuators respectively corresponding to the pressure chambers 110 and has a function for applying ejection energy selectively to the ink in the pressure chambers 110.

As shown in FIG. 2, ten liquid-supply openings 105*b* are opened in the upper face 9*a* of the channel unit 9 in correspondence with ink-outlet channels of the reservoir units. A lower face of the channel unit 9 is the liquid-ejection face 2*a*, and the plurality of liquid-ejection openings 108 are arranged in matrix in the lower face of the channel unit 9. It is noted that the liquid-ejection openings 108 are arranged so as to be spaced to one another in the main scanning direction at 600 dpi which is a resolution in the main scanning direction.

Figure 5:
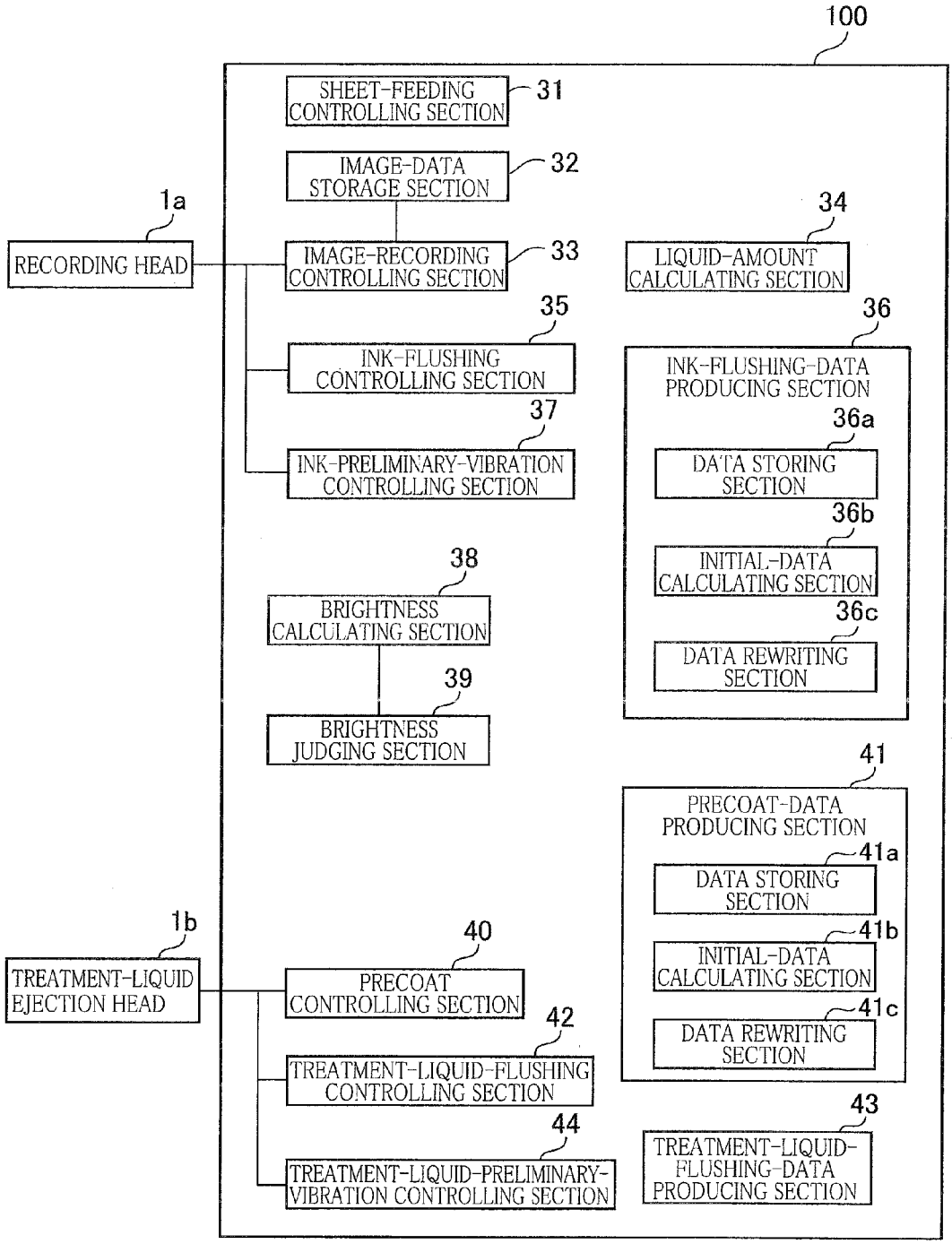

Further, as shown in FIG. 1, in the casing 101*a* is disposed the controller 100 configured to control entire operations of the ink-jet printer 101. Hereinafter, there will be explained the controller 100 with reference to FIG. 5. The controller 100 includes a Central Processing Unit (CPU), an Electrically Erasable and Programmable Read Only Memory (EEPROM) for rewritably storing programs executed by the CPU and data used for the programs, and a Random Access Memory (RAM) for temporarily storing data during execution of the programs. The controller 100 includes various functioning sections which are constituted by cooperation of these hardwares and softwares in the EEPROM with each other. Specifically, as shown in FIG. 5, the controller 100 includes a sheet-feeding controlling section 31, an image-data storage section 32, an image-recording controlling section 33, a liquid-amount calculating section 34, an ink-flushing controlling section 35, an ink-flushing-data producing section 36 as a flushing-operation-data producing section, an ink-preliminary-vibration controlling section 37 as a first vibration controlling section, a brightness calculating section 38, a brightness judging section 39, a precoat controlling section 40 as a second-liquid controlling section, a precoat-data producing section 41 as a second-liquid-ejection-data producing section, a treatment-liquid-flushing controlling section 42 as a second-liquid flushing-operation controlling section, a treatment-liquid-flushing-data producing section 43 as a second-liquid flushing-operation-data producing section, and a treatment-liquid-preliminary-vibration controlling section 44 as a second vibration controlling section.

The sheet-feeding controlling section 31 controls a plurality of motors, not shown, for respectively driving the sheet-supply roller 12, the pair of sheet-feed rollers 14, the belt roller 7, the pair of sheet-feed rollers 27, the pair of sheet-feed rollers 28, and the pairs of sheet-resupply rollers 25. Specifically, where the image is to be recorded on only one of the faces (i.e., sides) of the sheet P, that is, one side recording is performed, the sheet-feeding controlling section 31 controls the motors such that the uppermost one of the sheets P accommodated in the sheet-supply tray 11 is supplied, then fed through the position between the five heads 1 and the sheet-feed belt 8, and finally discharged onto the sheet-discharge opening 22. Where the two side recording is performed, the sheet-feeding controlling section 31 controls the motors such that the sheet P is supplied from the sheet-supply tray 11, fed to a downstream side of the heads 1 in the forward sheet feeding direction, then fed in the reverse sheet feeding direction to the two-side recording mechanism 24 to be flipped over in the two-side recording mechanism 24, then fed again in the forward sheet feeding direction, and finally discharged onto the sheet-discharge opening 22.

The image-data storage section 32 stores image data based on which the image recording is performed on the sheet P. The image-recording controlling section 33 controls the actuators of the actuator units 21 of each recording head 1*a* on the basis of the image data stored in the image-data storage section 32. Specifically, the image-recording controlling section 33 controls intervals of the ejection of the ink (hereinafter may be referred to as "ink-ejection intervals") such that the ink ejected as ink droplets from the liquid-ejection openings 108 of each recording head 1*a* is landed on the sheet P so as to form image dots on the sheet P at spaces of a distance corresponding to 600 dpi as a resolution in the sub-scanning direction, i.e., at spaces of 1/600 inch.

Figure 8:
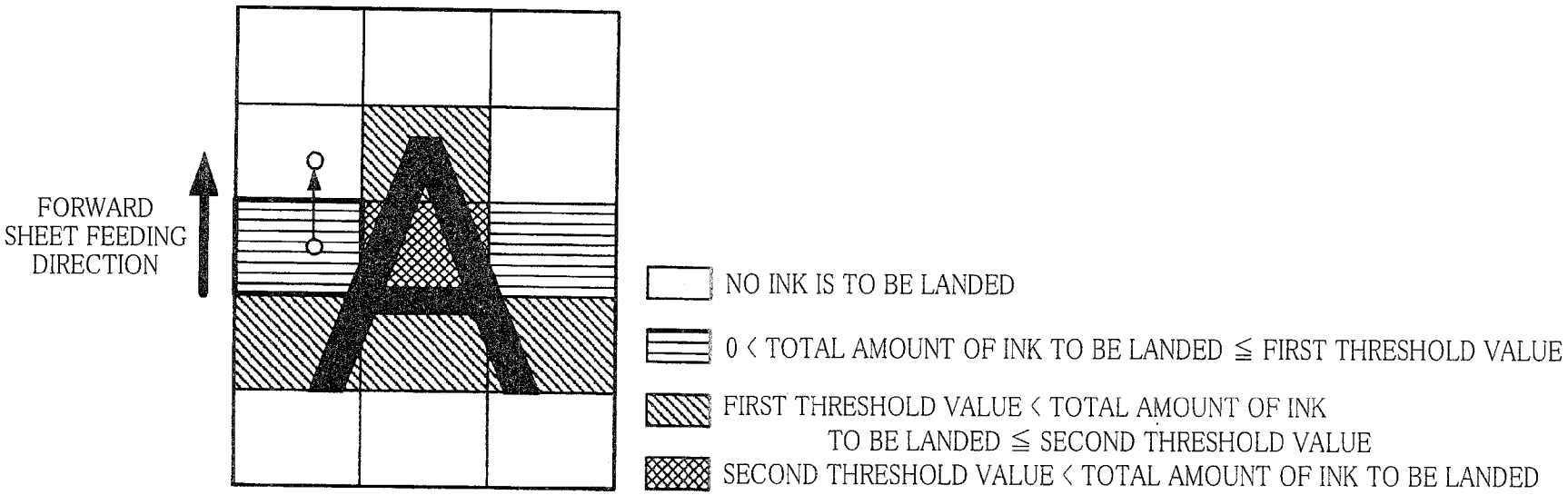
FIG. 8 is a view showing a sheet divided into a plurality of blocks when a calculation is performed by a liquid-amount calculating section shown in FIG. 5.

The liquid-amount calculating section 34 virtually splits the sheet P into a plurality of blocks each constituted by a plurality of dot areas and calculates, for each of the blocks, a total amount of the ink to be ejected from each recording head 1*a* and landed on the sheet P on the basis of the control of the image-recording controlling section 33. In the present embodiment, as shown in FIG. 8, the liquid-amount calculating section 34 splits the sheet P into fifteen blocks and calculates the total amount of the ink to be landed on each block. The total amount of the ink to be landed on each block is calculated by summing ink amounts of the respective image dots to be landed on each block, for example.

The ink-flushing controlling section 35 controls the actuators of the actuator units 21 of each recording head 1*a* on the basis of flushing data of the ink produced by the ink-flushing-data producing section 36 in order to perform flushing for ejecting onto the sheet P ink which is located near the liquid-ejection openings 108 and whose viscosity has been increased. That is, the ink-flushing controlling section 35 controls the actuators so as to adjust the ink-ejection intervals such that flushing dots are formed on the sheet P by the landing of the ink ejected from the liquid-ejection openings 108 of each recording head 1*a* at the intervals of 1/600 inch corresponding to the resolution in the sub-scanning direction on the basis of the drive of the actuators not based on the image data stored in the image-data storage section 32. Specifically, where there is any liquid-ejection opening 108 not used for the ink ejection for equal to or longer than a predetermined length of time during the image recording based on the control of the image-recording controlling section 33, for example, the ink-flushing controlling section 35 controls the actuators such that the ink is ejected from the liquid-ejection opening(s) 108 not used. It is noted that the predetermined length of time varies with a color of the ink, an ambient temperature and humidity, and the like. Further, in a data processing, a distance between the image dots (hereinafter may be referred to as an "image-dots distance") obtained by multiplying a feeding speed of the sheet P by the predetermined length of time may be used instead of the predetermined length of time. In this case, the ink is ejected so as to faun the flushing dots by using liquid-ejection openings 108 not used for the ink ejection for forming the image dots within this image-dots distance.

As described above, in the present embodiment, each of the resolutions in the main scanning direction and the sub-scanning direction is 600 dpi, and the sheet P is virtually partitioned into the plurality of dot areas in a grid pattern, each of which has a square shape whose length is 1/600 inch in the main scanning direction and the sub-scanning direction. In other words, each of the dot areas has a first length corresponding to the resolution in the main scanning direction and a second length corresponding to the resolution in the sub-scanning direction.

The ink-flushing-data producing section 36 includes (a) a data storing section 36*a* configured to store data concerning the dot areas on which the flushing dots are respectively formed, (b) an initial-data calculating section 36*b* configured to temporarily determine the dot areas on which the flushing dots are respectively formed, and (c) a data rewriting section 36*c* configured to rewrite the data stored in the data storing section 36*a*.

The initial-data calculating section 36*b* searches for the liquid-ejection openings 108 in each of which each ink-ejection interval is equal to or longer than the predetermined length of time, on the basis of the ink-ejection intervals in each liquid-ejection opening 108 of the recording heads 1*a* by the control of the image-recording controlling section 33. Then, the initial-data calculating section 36*b* stores, into the data storing section 36*a*, the dot areas to which the ink ejected from the searched liquid-ejection openings 108 is landed, such that each ink-ejection interval becomes shorter than the predetermined length of time. Alternatively, the image-dots distance obtained by multiplying the feeding speed of the sheet P stored in the sheet-feeding controlling section 31 by the predetermined length of time is used instead of the predetermined length of time, and the initial-data calculating section 36*b* stores, into the data storing section 36*a*, the dot areas to which the ink ejected from the searched liquid-ejection openings 108 is landed, such that each ink-ejection interval becomes shorter than this image-dots distance.

The data rewriting section 36*c* rewrites, where there are two dot areas which are stored in the data storing section 36*a* and which overlap with each other on both faces of the sheet P when the two side recording is performed, the data stored in the data storing section 36*a* such that a position of one of the two dot areas is changed to a dot area located on a downstream side thereof in the forward sheet feeding direction, i.e., a dot area nearer to a leading end of the sheet P than the dot area on which the ink is to be landed. That is, a timing of the ejection of the ink which has been planned to be landed on the one dot area is made earlier.

Further, the controller 100 judges, for each dot area, whether or not there is any less ink block in which a total amount of the ink calculated by the liquid-amount calculating section 34 is smaller than that in a to-be-landed block including the dot area stored in the data storing section 36*a*, at a position located on a downstream side of the to-be-landed block including the dot area in the forward sheet feeding direction. Where the controller 100 has judged that there is such a less ink block, the data rewriting section 36*c* rewrites a content stored in the data storing section 36*a* for the dot area so as to change a position of the dot area to a dot area in the less ink block. More specifically, each less ink block is selected from among blocks located between the to-be-landed block and an immediately preceding block on which is landed the ink (i.e., an ink droplet) that is ejected from the same liquid-ejection opening 108 immediately before the ejection of the ink onto the less ink block.

It is noted that, in the present embodiment, the image-recording controlling section 33 and the ink-flushing controlling section 35 can adjust the ink amount of each of the image dot and the flushing dot formed on the sheet P by the ink ejected from each liquid-ejection opening 108 of the recording heads 1*a* in three levels, namely, a large droplet, a medium-size droplet, and a small droplet.

The ink-preliminary-vibration controlling section 37 controls the actuators of the actuator units 21 of each recording head 1*a* such that an energy is applied to the ink for vibrating a meniscus of the ink formed in or near each liquid-ejection openings 108 which has not used for the ink ejection for equal to or longer than the predetermined length of time, in order to prevent the ink from solidifying in or near the liquid-ejection openings 108.

The brightness calculating section 38 calculates brightness of each of the image dots and the flushing dots formed on the sheet P on the basis of the color and the amount of the ink ejected from the liquid-ejection openings 108 of each recording head 1*a*. Specifically, as shown in the table in FIG. 6, weights are assigned to the respective ink colors in order from a deep one, that is, "1" is assigned to black, "2" to magenta, "3" to cyan, and "4" to yellow. Further, weights are assigned to the ink amounts in order from a large amount, that is, "1" is assigned to the large droplet, "2" to the medium-size droplet, and "3" to the small droplet. The brightness calculating section 38 calculates the brightness by multiplying the weight of the ink color and the weight of the ink amount together. That is, in the case of a yellow medium-size droplet, the brightness is eight (4×2), and in the case of a black small droplet, the brightness is three (1×3), for example.

The brightness judging section 39 judges (a) a high and low relationship in brightness between two dots formed in the sheet P and (b) a difference in brightness between the two dots on the basis of a result of the calculation of the brightness calculating section 38. That is, when comparing the image dot formed by the yellow medium-size droplet and the flushing dot formed by the black small droplet, for example, the brightness judging section 39 judges that the flushing dot is lower in brightness than the image dot and the difference thereof is five (8−3) because the brightness of the image dot is eight while the brightness of the flushing dot is three as described above.

The precoat controlling section 40 controls the actuators of the actuator units 21 of the treatment-liquid ejection head 1*b* on the basis of data produced by the precoat-data producing section 41.

The precoat-data producing section 41 produces the data concerning the dot areas to which the treatment liquid is to be landed and an amount of the treatment liquid to be ejected. The precoat-data producing section 41 produces the data such that the treatment liquid is landed on dot areas on which the ink is to be landed on the basis of the control of the image-recording controlling section 33 among the plurality of the dot areas on the sheet P, and such that no treatment liquid is landed on any dot area on which the ink is to be landed on the basis of the control of the ink-flushing controlling section 35 among the plurality of the dot areas on the sheet P.

Further, the precoat-data producing section 41 produces the data on the basis of a result of the calculation of the liquid-amount calculating section 34 such that the smaller the total amount of the ink to be landed on one of the blocks, the smaller amount of the treatment liquid is to be landed on the block. It is noted that, in the present embodiment, the precoat-data producing section 41 adjusts the amount of the treatment liquid landed on each block by adjusting the number of the dot areas on which the treatment liquid is landed.

Further, the precoat-data producing section 41 includes (a) a data storage section 41*a* configured to store data concerning the dot areas on each of which the treatment liquid is to be landed and the amount of the treatment liquid to be ejected, (b) an initial-data calculating section 41*b* configured to temporarily determine the dot areas on which the treatment liquid is to be landed, and (c) a data rewriting section 41*c* configured to rewrite the data stored in the data storage section 41*a*.

For each block, the initial-data calculating section 41*b* stores dot areas into the data storage section 41*a* as the dot areas on which the treatment liquid is to be landed. The stored dot areas are obtained by subtracting or reducing dot areas from all the dot areas in the block in accordance with a subtracting rate determined on the basis of the total amount of the ink to be landed on the block which amount is calculated by the liquid-amount calculating section 34.

For example, the initial-data calculating section 41*b* stores the dot areas in the following manner. That is, two threshold values, namely, a first threshold value and a second threshold value which is larger than the first threshold value (i.e., the first threshold value < the second threshold value) are initially set in relation to the total amount of the ink to be landed on each block. In the block(s) on which no ink is to be landed (indicated by white blocks in FIG. 8), no treatment liquid is to be landed on any of the dot areas. In the block(s) in which the total amount of the ink is equal to or smaller than the first threshold value (indicated by horizontal-line blocks), dot areas obtained by subtracting 80% of all the dot areas from all the dot areas are set as the dot areas on which the treatment liquid is to be landed. In the block(s) on which the total amount of the ink is larger than the first threshold value and equal to or smaller than the second threshold value (indicated by oblique-line blocks in FIG. 8), dot areas obtained by subtracting 50% of all the dot areas from all the dot areas are set as the dot areas on which the treatment liquid is to be landed. In the block(s) on which the total amount of the ink is larger than the second threshold value (indicated by hatched blocks in FIG. 8), all the dot areas in each of the block(s) are set as the dot areas on which the treatment liquid is to be landed.

Where there is any dot area overlapping with the dot area(s) on which the flushing dot is to be formed, among the dot areas which are stored in the data storage section 41*a* and on which the treatment liquid is to be landed, the data rewriting section

41*c* deletes the dot area(s) from the data storage section 41*a* or rewrites the data stored in the data storage section 41*a* such that the amount of the treatment liquid to be landed on the dot area is set to zero.

Where the dot area on which the image dot is to be formed and the treatment liquid is to be landed and the dot area on which the flushing dot is to be formed are adjacent to each other, the data rewriting section 41*c* rewrites the data stored in the data storage section 41*a* such that the amount of the treatment liquid to be landed on the dot area on which the image dot is to be formed becomes small in comparison with the case where the dot areas are not adjacent to each other. More specifically, the data rewriting section 41*c* rewrites the data on the basis of a result of the calculation of the brightness judging section 39 such that the lower the brightness of the flushing dot in comparison with the brightness of the image dot to be formed on the dot area adjacent to the dot area on which the flushing dot is to be formed (that is, the larger a difference between the brightness of the flushing dot and the brightness of the image dot), the smaller amount of the treatment liquid is to be landed on the dot area on which the image dot is to be formed. It is noted that, in the present embodiment, the precoat controlling section 40 can adjust the amount of the treatment liquid to be ejected onto each of the dot areas from each liquid-ejection opening 108 of the treatment-liquid ejection head 1*b* in the three levels. That is, the treatment liquid is ejected from the liquid-ejection openings 108 as treatment liquid droplets of three sizes (i.e., the large droplet, the medium-size droplet, and the small droplet). Thus, the data rewriting section 41*c* rewrites the data such that, though the large droplet is normally used, the medium-size droplet is used where the difference between the brightness of the flushing dot and the brightness of the image dot adjacent to the image dot is equal to or larger than zero and smaller than six, and rewrites the data such that the small droplet is used where the difference is equal to or larger than six and equal to or smaller than eleven, for example.

The treatment-liquid-flushing controlling section 42 controls the actuators of the actuator units 21 of the treatment-liquid ejection head 1*b* on the basis of data produced by the treatment-liquid-flushing-data producing section 43 in order to perform flushing for ejecting, onto the sheet P, treatment liquid which adheres to positions of the liquid-ejection face 2*a* near the respective liquid-ejection openings 108 and whose viscosity has been increased. The treatment-liquid-hushing-data producing section 43 produces flushing data of the treatment liquid on the basis of the control of the ink-flushing controlling section 35 such that no treatment liquid is to be landed on any of the dot area(s) on which the ink is to be landed.

The treatment-liquid-preliminary-vibration controlling section 44 controls the actuators of the actuator units 21 of the treatment-liquid ejection head 1*b* such that an energy is applied to the treatment liquid for vibrating a meniscus of the treatment liquid formed in or near each liquid-ejection opening 108 which has not used for the ejection of the treatment liquid for equal to or longer than the predetermined length of time, in order to prevent the treatment liquid from solidifying in or near the liquid-ejection openings 108.

Figure 7:
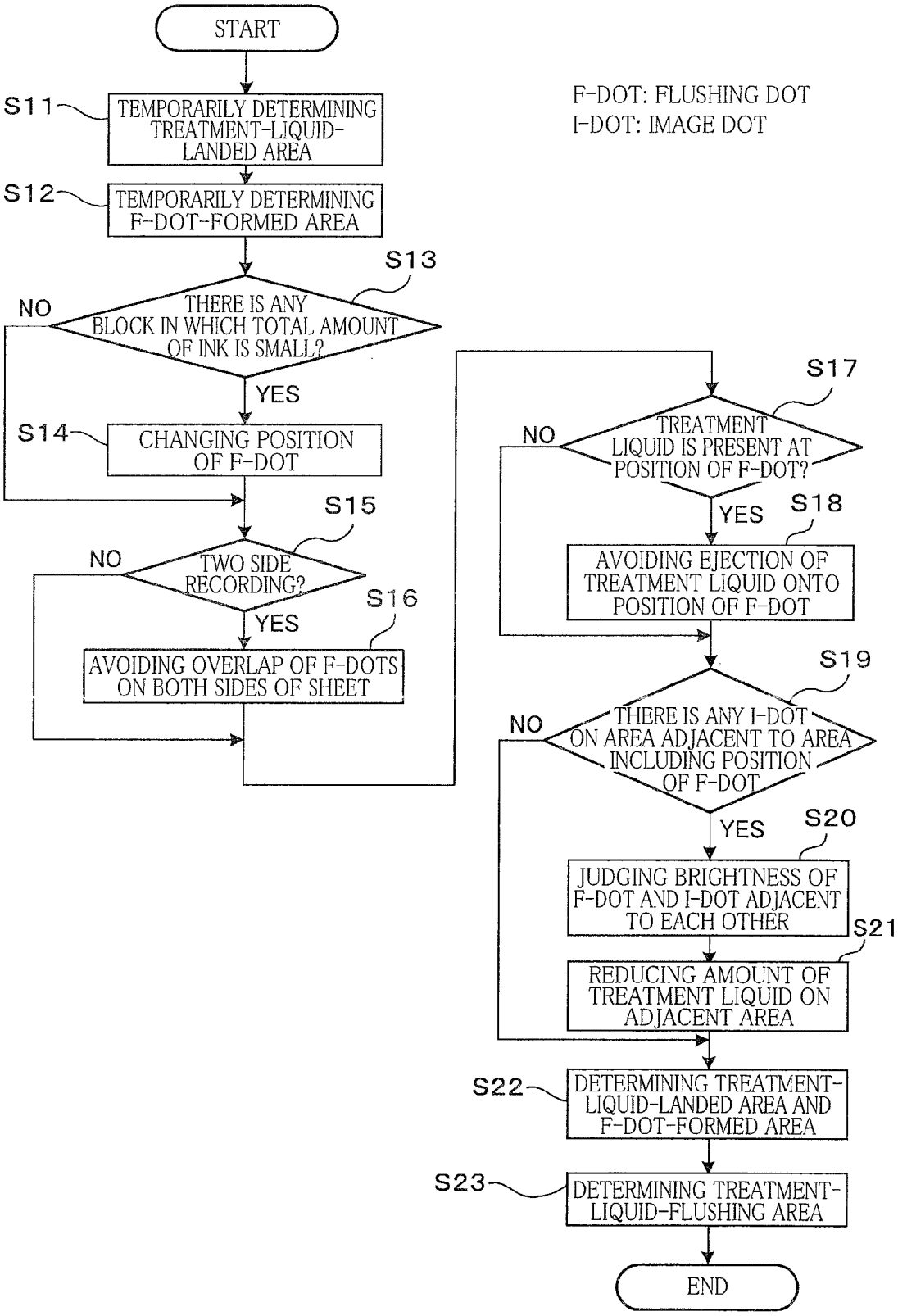
FIG. 7 is a flow-chart showing an example of a processing performed by a controller shown in FIG. 5.
Figure 9A:
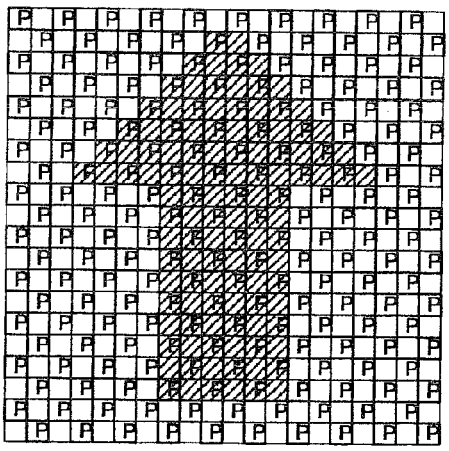
FIGS. 9A to 9C are views showing a process for determining an area onto which the ink is ejected by a control of an ink-flushing controlling section shown in FIG. 5 and an area onto which treatment liquid is ejected by a control of a precoat controlling section in FIG. 5.

There will be next explained, with reference to FIG. 7, an example of a processing performed by the controller 100 when the image is formed in the printer 101. It is noted that a processing for storing the image data into the image-data storage section 32 is performed before this processing, but an explanation of which is dispensed with. Initially, in S11, the initial-data calculating section 41*b* of the precoat-data producing section 41 temporarily determines the dot areas on which the treatment liquid is to be landed, on the basis of the result of the calculation of the liquid-amount calculating section 34 based on the image data stored in the image-data storage section 32. Specifically, for example, where the total amount of the ink to be ejected onto the block including dot areas shown in FIG. 9A on the basis of the control of the image-recording controlling section 33 is larger than the first threshold value and equal to or smaller than the second threshold value, the initial-data calculating section 41*b* temporarily determines that an area obtained by subtracting 50% of all the dot areas in the block from all the dot areas is an area onto which the treatment liquid is to be ejected (i.e., areas marked with "P" in FIGS. 9A to 9B). The dot areas thus determined are stored into the data storage section 41*a*.

Figure 9B:
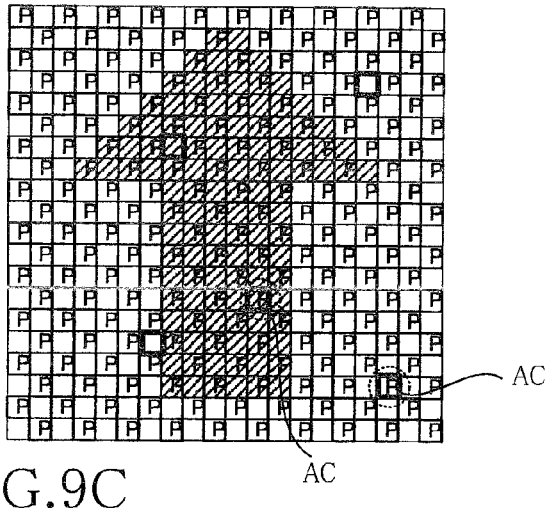

Then, in S12, the initial-data calculating section 36*b* of the ink-flushing-data producing section 36 temporarily determines the dot areas on which the flushing dots are to be formed by the ejection of the ink from the recording heads 1*a* by the control of the ink-flushing controlling section 35. Specifically, where there is any liquid-ejection opening 108 not used for the ink ejection for equal to or longer than the image-dots distance obtained by multiplying the feeding speed of the sheet P stored in the sheet-feeding controlling section 31 by the predetermined length of time, the initial-data calculating section 36*b* determines, for each of the not-used liquid-ejection opening(s) 108, the dot areas such that the flushing dots are formed so as to be spaced to one another at this image-dots distance. In the present embodiment, as shown in FIG. 9B, the initial-data calculating section 36*b* determines the dot areas (each enclosed with a bold line) on which the flushing dots are respectively to be formed, for example. As shown in FIG. 9B, each flushing dot may be formed on the dot area on which the image dot is not to be formed, i.e., a position partly constituting a background, and may be formed on the same area as the dot area (indicated by oblique-line areas) on which the image dot is to be formed.

It is noted that, where the flushing dot and the image dot are formed so as to overlap with each other, either of the flushing dot and the image dot may be formed first. That is, the ink to be ejected from the recording head 1*a* for magenta by the control of the ink-flushing controlling section 35 is to be landed on the dot area on which is to be landed the ink ejected from the recording head 1*a* for cyan before the ejection of the magenta ink or the ink to be ejected from the recording head 1*a* for yellow or black after the ejection of the magenta ink by the control of the image-recording controlling section 33, for example. Since the image recording is performed by using a plurality of the recording heads 1*a* in FIGS. 9A to 9C, there may be caused a case in which, even where the dot area is adjacent to or overlaps with the image dot as shown in FIG. 9B, the flushing dot is formed by the recording head 1*a* different from the recording head 1*a* corresponding to the image dot.

Then, in S13, for each dot area on which the flushing dot temporarily determined in S12 is to be formed, the controller 100 judges whether or not there is any less ink block (i.e., less liquid block) on a downstream side of a corresponding to-be-landed block (enclosed with the bold line) including the dot area in the forward sheet feeding direction among the blocks on the sheet P as shown in FIG. 8. The less ink block is a block in which the total amount of the ink is smaller than that in the corresponding to-be-landed block. Where the controller 100 has judged that there is no less ink block (S13: NO), this processing goes to S15 by skipping S14 which will be described below. For example, as a boundary for judging the presence of the less ink block on a downstream side of the to-be-landed block in the forward sheet feeding direction, there is used a block located at a position corresponding to half the image-dots distance from the dot area for forming the above-described flushing dot.

On the other hand, where the controller 100 has judged that there is any less ink block (S13: YES), the data rewriting section 36*c* changes in S14 a position on which the ink is to be landed in the to-be-landed block and rewrites the data stored in the data storing section 36*a* such that the ink is to be landed on the less ink block. In FIG. 8, a block adjacent to the to-be-landed block on a downstream side of the to-be-landed block in the forward sheet feeding direction is the less ink block, and a position of the flushing dot to be formed in the to-be-landed block is changed to the inside of the less ink block.

Then, in S15, the controller 100 judges whether the two side recording is to be performed or not. Where the controller 100 has judged that the two side recording is not to be performed (S15: NO), this processing goes to S17 by skipping S16 which will described below. On the other hand, where the controller 100 has judged that the two side recording is to be performed (S15: YES), the controller 100 rewrites the data in S16 such that the dot areas on which flushing dots are to be formed do not overlap with each other on both sides of the sheet P. Specifically, where there are dot areas overlapping with each other on both sides of the sheet P among the dot areas stored in the data storing section 36*a*, the data rewriting section 36*c* rewrites the data stored in the data storing section 36*a* such that a position of one of the dot areas is changed to a dot area located on a downstream side of the one dot area in the forward sheet feeding direction. It is noted that, in the present embodiment, the change of the position of the dot area in S16 is performed in the same block.

Figure 9C:
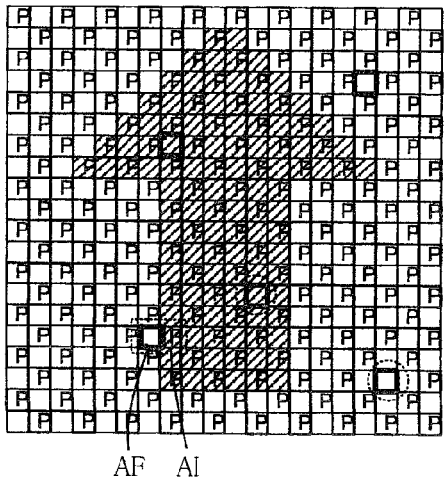

Further, the controller 100 judges in S17 whether or not there is any dot area which overlaps with any dot area on which the treatment liquid is to be landed and which has been temporarily determined in S11, among the dot areas on which the flushing dots are respectively to be formed. Where the controller 100 has judged that there is no dot area which overlaps with the dot area (S17: NO), this processing goes to S19 by skipping S18 which will be described below. On the other hand, where the controller 100 has judged that there is any dot area which overlaps with the dot area (S17: YES), this processing goes to S18. In S18, the data rewriting section 41*c* of the precoat-data producing section 41 deletes, from the data storage section 41*a*, the dot area(s) each overlapping with the corresponding dot area on which the flushing dot is to be found, among the temporarily determined dot areas on which the treatment liquid is to be landed. In the example shown in FIG. 9B, two dot areas AC each enclosed with a broken-line circle among the dot areas on which the flushing dots are respectively to be formed (i.e., the dot areas each enclosed with the bold line) overlap respectively with the dot areas on which the treatment liquid is to be landed (i.e., the areas marked with "P"). Thus, as shown in FIG. 9C, the treatment liquid is not discharged onto the dot area(s) each overlapping with the corresponding dot area on which the flushing dot is to be formed.

Then, in S19, the controller 100 judges whether or not there is any dot area on which the image dot is to be formed and the treatment liquid is to be landed, among the dot areas adjacent to the dot area on which the flushing dot is to be formed. Where the controller 100 has judged that there is no such dot area (S19: NO), this processing goes to S22 by skipping S20 and S21 which will be described below. On the other hand, the controller 100 has judged that there is the dot area described above (S19: YES), the brightness judging section 39 judges in S20 a high and low relationship in brightness between these two dots to be formed on the dot areas adjacent to each other and a difference in brightness between these two dots.

Further, in S21, the data rewriting section 41*c* rewrites, on the basis of the result of the judgment in S20, the data stored in the data storage section 41*a* such that the lower the brightness of the flushing dot in comparison with the brightness of the image dot to be formed on the dot area adjacent to the dot area on which the flushing dot is to be formed, the smaller amount of the treatment liquid is to be landed on the dot area on which the image dot is to be formed. Here, there will be specifically explained the operation in S21 by discussing, as an example, the case of the two dot areas AF, AI enclosed with a broken-line rectangle shown in FIG. 9C. A left one of the two dot areas, i.e., the dot area AF is an area on which the flushing dot is to be formed, and a right one of the two dot areas, i.e., the dot area AI is an area on which the image dot is to be formed and the treatment liquid is to be landed. Where the flushing dot to be formed on the left dot area AF is a black small droplet while the image dot to be formed on the right dot area AI is a yellow medium-size droplet, the flushing dot is smaller in brightness than the image dot and a difference therebetween is five in accordance with the table in FIG. 6. Thus, in this case, the amount of the treatment liquid to be ejected onto the right dot area AI is reduced.

Then, in S22, the controller 100 determines (a) the dot area(s) on each of which the flushing dot is to be formed, (b) the dot area(s) on each of which the treatment liquid is to be landed, and (c) the amount of the treatment liquid which have been finally determined in the above-described steps. That is, the controller 100 determines a content stored in the data storing section 36*a* of the ink-flushing-data producing section 36 and a content stored in the data storage section 41*a* of the precoat-data producing section 41. Further, in S23, the controller 100 determines the dot area(s) on which the treatment liquid to be ejected from the treatment-liquid ejection head 1*b* on the basis of the data stored in the treatment-liquid-flushing-data producing section 43 is to be landed. In this operation, the treatment-liquid-flushing-data producing section 43 produces the flushing data of the treatment liquid such that the treatment liquid is not to be landed on the dot area(s) on which the flushing dot is to be formed and which has been determined in S22.

In view of the above, the controller 100 can be considered to include a first-liquid temporarily-landed-area determining section configured to temporarily determine the dot area on which the ink is to be landed by the flushing operation, as a first-liquid temporarily landed area on the basis of the image data stored in the image-data storage section 32, and this first-liquid temporarily-landed-area determining section can be considered to perform the processing of S12. Further, the controller 100 can be considered to include a second-liquid temporarily-landed-area determining section configured to temporarily determine the dot areas on which the treatment liquid is to be landed, as second-liquid temporarily landed areas on the basis of the image data stored in the image-data storage section 32, and this second-liquid temporarily-landed-area determining section can be considered to perform the processing of S11. Further, the controller 100 can be considered to include a judging section configured to judge whether at least one of the second-liquid temporarily landed areas overlaps with the first-liquid temporarily landed area temporarily determined by the first-liquid temporarily-landed-area determining section or not, and this judging section can be considered to perform the processing of S17. Further, the controller 100 can be considered to include a first-liquid-landed-area determining section configured to determine, where the judging section has judged that at least one of the second-liquid temporarily landed areas overlaps with the first-liquid temporarily landed area, the dot area on which the ink is to be landed by the flushing operation so as not to overlap with the first-liquid temporarily landed area, as a first-liquid landed area, and this first-liquid-landed-area determining section can be considered to perform the processing of S18.

As described above, in the ink-jet printer 101 as the present embodiment, the precoat-data producing section 41 produces the data about the ejection of the treatment liquid such that the treatment liquid is to be landed on only any of the dot area(s) on which the ink is to be landed on the basis of the control of the image-recording controlling section 33, and such that no treatment liquid is to be landed on any dot area on which the ink is to be landed on the basis of the control of the ink-flushing controlling section 35. Thus, each flushing dot to be formed by the ink ejected on the basis of the control of the ink-flushing controlling section 35 is to be formed on the corresponding dot area on which is not to be landed the treatment liquid for reducing the degree of the permeation of the ink into the sheet P. Consequently, since the ink for forming such a flushing dot is easily permeated into the sheet P, it is possible to prevent the flushing dot from being easily recognized by a viewer.

Further, in this ink-jet printer 101, the treatment-liquid ejection head 1*b* is located on an upstream side of the recording heads is in the forward sheet feeding direction, and the treatment liquid ejected from the treatment-liquid ejection head 1*b* before the landing of the ink is landed on the dot area(s) on which the ink ejected from the recording heads 1*a* is landed. Thus, the ink for forming the image dots is not easily absorbed into the sheet P, thereby sharpening the image dots. Further, the ink for forming the flushing dots is absorbed into the sheet P, and thus the flushing dots are not easily recognized by the viewer.

Further, in this ink jet printer 101, the ink-flushing-data producing section 36 produces the data about the flushing such that the flushing dot is to formed on an area the same as the dot area on which the image dot is to be formed by the recording head 1*a* different from the recording head 1*a* for forming the flushing dot, in addition to a dot area on which the image dot is not to be formed, i.e., a position partly constituting the background. Thus, since the flushing dot and the image dot are to be formed so as to overlap with each other, the flushing dots are made further inconspicuous. Further, the treatment liquid is not to be landed on the dot area on which this flushing dot is to be landed. Thus, even where this flushing dot is formed on the area which is the same as the dot area on which the image dot is formed, it is possible to restrain the flushing dot from being easily recognized by the viewer.

Further, in this ink-jet printer 101, the precoat-data producing section 41 produces the data about the ejection of the treatment liquid such that the smaller amount of the treatment liquid is to be landed on the dot area on which the image dot is to be formed where the dot area on which the image dot is to be formed and the treatment liquid is to be landed and the dot area on which the flushing dot is to be formed are adjacent to each other than where these two dot areas are not adjacent to each other. Thus, it is possible to prevent, where the treatment liquid to be landed on the dot area on which the image dot is to be formed is permeated into the sheet P and spreads to the adjacent dot area, the reduction of the degree of the permeation of the ink for forming the flushing dot to be formed on the adjacent dot area, into the sheet P. Thus, it is possible to further reliably prevent the flushing dot from being conspicuous.

In addition, in this ink jet printer 101, where the dot area on which the image dot is to be formed and the treatment liquid is to be landed and the dot area on which the flushing dot is to be formed are adjacent to each other, the precoat-data producing section 41 produces the data of the ejection of the treatment liquid such that the lower the brightness of the flushing dot in comparison with the brightness of the image dot to be formed on the dot area adjacent to the dot area on which the flushing dot is to be formed, the smaller amount of the treatment liquid is to be landed on the dot area on which the image dot is to be formed. Thus, where the brightness of the flushing dot is relatively low and easily recognized by the viewer, a relatively large amount of the treatment liquid to be landed on the adjacent dot area is reduced, thereby reliably preventing the reduction of the degree of the permeation of the ink for forming the flushing dot, into the sheet P. Further, it is possible to prevent the flushing dot from being easily recognized by the viewer. Further, where the brightness of the flushing dot is relatively high and is not easily recognized by the viewer, the amount of the treatment liquid is not greatly reduced, thereby sharpening the image dot to be formed on the adjacent dot area. Thus, the quality of the image recording can be improved.

Further, in this ink-jet printer 101, the ink-flushing-data producing section 36 produces the data about the flushing such that the dot areas for forming the flushing dots do not overlap with each other on both sides of the sheet P upon performing the two side recording. Thus, where all the ink forming the flushing dots cannot be permeated into the sheet P to be accumulated on the vicinity of a surface of the sheet upon forming the flushing dots on the both faces of the sheet P, it is possible to prevent the flushing dots from being easily recognized by the viewer.

Further, in this ink-jet printer 101, the liquid-amount calculating section 34 splits the sheet P into the plurality of blocks constituted by the plurality of dot areas and calculates, for each block, the total amount of the ink to be landed on the sheet P by the ejection on the basis of the control of the image-recording controlling section 33. Further, the precoat-data producing section 41 produces the data about the ejection of the treatment liquid on the basis of the calculation of the liquid-amount calculating section 34 such that the smaller the total amount of the ink to be landed on each block, the smaller amount of the treatment liquid is to be landed on the block. Further, where there is any less ink block in which the total amount of the ink to be landed is relatively small, at the position located on a downstream side, in the forward sheet feeding direction, of the to-be-landed block including the dot area on which the ink ejected on the basis of the control of the ink-flushing controlling section 35 is to be landed, the ink-flushing-data producing section 36 changes the position on which the ink is to be landed, such that the ejected ink is to be landed on the less ink block. Thus, the flushing dot can be formed on the block in which an amount of the applied treatment liquid is relatively small. Consequently, it is possible to prevent that, where the treatment liquid landed on a certain dot area has spread to the dot area on which the flushing dot is to be formed, the degree of the permeation of the ink for forming the flushing dot into the sheet P is reduced. As a result, it is possible to further reliably prevent the flushing not from being easily recognized by the viewer.

Further, this ink-jet printer 101 includes the treatment-liquid-flushing-data producing section 43 configured to produce the flushing data of the treatment liquid such that the treatment liquid is not to be landed on any dot area on which is to be landed the ink on the basis of the control of the ink-flushing controlling section 35. Thus, it is possible to prevent that the flushing dot is conspicuous where the ink for forming the flushing dot is landed on the treatment liquid ejected upon the flushing for the treatment-liquid ejection head 1*b*.

In addition, this ink-jet printer 101 includes the ink-preliminary-vibration controlling section 37 configured to control each recording head 1*a* such that the energy is applied for vibrating the meniscus of the ink in or near each liquid-ejection opening 108 not used for the ink ejection. Further, this ink jet printer 101 includes the treatment-liquid-preliminary-vibration controlling section 44 configured to control the treatment-liquid ejection head 1*b* such that the energy is applied for vibrating the meniscus of the treatment liquid in or near each liquid-ejection opening 108 not used for the ejection of the treatment liquid. Thus, the number of the flushings performed by the head 1 can be reduced, thereby reducing consumptions of the ink and the treatment liquid.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

For example, in the above-described embodiment, the precoat-data producing section 41 produces the data about the ejection of the treatment liquid such that no treatment liquid is to be landed on any dot area on which the ink is to be landed on the basis of the control of the ink-flushing controlling section 35, but the present invention is not limited to this configuration. For example, the precoat-data producing section 41 may produce the data such that the treatment liquid is not to be landed on at least one dot area on which the ink is to be landed on the basis of the control of the ink-flushing controlling section 35. For example, where the dot area on which the image dot is to be formed and the dot area on which the flushing dot is to be formed are adjacent to each other, the precoat-data producing section 41 may produce the data such that the treatment liquid is not landed only on the dot area on which the flushing dot is formed and such that the treatment liquid is landed on the dot areas on which other flushing dots are respectively formed. Normally, the treatment liquid is also landed on a dot area adjacent to the dot area on which the image dot is to be formed, in order to improve fixing of the ink for forming the image dot. Thus, where the dot area adjacent to the dot area on which the image dot is to be formed is a dot area on which the flushing dot is to be formed, the treatment liquid is not to be landed on the dot area on which the flushing dot is to be formed, thereby preventing the flushing dot from being easily recognized by the viewer.

Further, in the above-described embodiment, where the dot area on which the image dot is to be formed and the treatment liquid is to be landed and the dot area on which the flushing dot is to be formed are adjacent to each other, the precoat-data producing section 41 produces the data about the ejection of the treatment liquid such that the lower the brightness of the flushing dot in comparison with the brightness of the image dot to be formed on the dot area adjacent to the dot area on which the flushing dot is to be formed, the smaller amount of the treatment liquid is to be landed on the dot area on which the image dot is to be formed, but the present invention is not limited to this configuration. For example, the precoat-data producing section 41 may produce the data such that the lower the brightness of the flushing dot in comparison with the brightness of the image dot to be formed on the dot area adjacent to the dot area on which the flushing dot is to be formed, the further position from the dot area on which the flushing dot is to be formed the treatment liquid is to be landed on. As a result, as in the above-described embodiment, even where the treatment liquid is permeated into the sheet P and spreads, it is possible to prevent the flushing dot from being conspicuous.

Further, in the above-described embodiment, the precoat-data producing section 41 produces the data about the ejection of the treatment liquid so as to adjust the number of the dot areas on which the treatment liquid is to be landed such that the smaller the total amount of the ink for forming image dot to be landed on the block, the smaller amount of the treatment liquid is to be landed on the block, but the present invention is not limited to this method for adjusting the amount of the treatment liquid to be landed on the block. For example, the amount of the treatment liquid to be landed on the block may be adjusted by adjusting an amount of the treatment liquid to be landed on each dot area without changing the number of the dot areas on which the treatment liquid is to be landed.

Further, in the above-described embodiment, there is used the treatment liquid which is applied on the sheet P in advance for reducing the degree of the permeation of the ink to be landed later, that is, pre-treatment liquid is used. However, there may be used treatment liquid which is to be landed on the ink ejected before for improving a degree of the solidification of the ink on the sheet P, that is, post-treatment liquid may be used. Where the post-treatment liquid is used in this printer 101, the treatment liquid is not applied to the dot area on which the flushing dot is to be formed. Thus, it is possible to restrain a promotion of the solidification of the ink for forming the flushing dot. As a result, part of a color component of the ink is permeated into the sheet P without being solidified on a surface of the sheet P. Thus, the color component remaining on the surface of the sheet P is reduced, thereby making the flushing dot inconspicuous. It is noted that, where the post-treatment liquid is used, the treatment-liquid ejection head 1*b* is disposed at a position located on a downstream side of the recording heads 1*a* in the forward sheet feeding direction.

Further, in the above-described embodiment, the sheet P is virtually split into the plurality of blocks, the present invention is not limited to this configuration. Where the blocks are not considered, the initial-data calculating section 41*b* determines, in S11 of the above-described processing performed by the controller 100, each of the dot areas on which the image dot is to be formed and the dot area adjacent to the dot area, as the dot area on which the treatment liquid is to be landed. In this case, the processings in S13 and S14 are omitted.

In addition, in the above-described embodiment, the printer 101 includes the two-side recording mechanism 24 configured to reverse the front and back faces of the sheet P in order to perform the image recording on both sides of the sheet P, but the two-side recording mechanism 24 may be omitted, or another mechanism may be used as the two-side recording mechanism 24. It is noted that, in the above-described embodiment, the ink-jet printer 101 produces the data of the ejection of the treatment liquid such that the treatment liquid is not to be landed on each dot area on which the flushing dot is to be formed, but the present invention is not limited to this configuration. For example, the ink-jet printer 101 may be configured such that the amount of the treatment liquid to be landed on the dot area on which the flushing dot is to be fixated is made smaller than the amount of the treatment liquid to be landed on the dot area on which the flushing dot is not to be formed. Also in this configuration, the amount of the treatment liquid to be landed on the dot area on which the flushing dot is to be formed is reduced, thereby preventing the flushing dot from being conspicuous. Further, the amount of the treatment liquid to be landed on the dot area on which the flushing dot is to be formed may be reduced stepwise, e.g., large, medium, and small in order, and may be reduced continuously.

Further, in the above-described embodiment, the ink-jet printer 101 produces the data of the ejection of the treatment liquid such that the treatment liquid is not to be landed on any of the dot areas on each of which the flushing dot is to be formed, but the present invention is not limited to this configuration. For example, the ink jet printer 101 may be configured such that the treatment liquid is not to be landed on at least one of the dot areas on each of which the flushing dot is to be formed. Also in this configuration, the number of the flushing dots on which the treatment liquid is to be landed is reduced, thereby preventing the flushing dot from being conspicuous.

Further, in the above-described embodiment, where the dot area on which the image dot is to be formed and the treatment liquid is to be landed and the dot area on which the flushing dot is to be formed are adjacent to each other, the ink-jet printer 101 produces the data of the ejection of the treatment liquid such that the lower the brightness of the flushing dot in comparison with the brightness of the image dot to be formed on the dot area adjacent to the dot area on which the flushing dot is to be formed, the smaller amount of the treatment liquid is to be landed on the dot area on which the image dot is to be formed, but the present invention is not limited to this configuration. For example, the ink-jet printer 101 may be configured such that, where the dot area on which the image dot is to be formed and the treatment liquid is to be landed and the dot area on which the flushing dot is to be fanned are adjacent to each other, and the brightness of the image dot is higher than that of the flushing dot, the amount of the treatment liquid to be landed on the dot area on which the image dot is to be formed is made smaller in the case where the difference between the brightness of the image dot and the brightness of the flushing dot is large than in the case where the difference is small. Also in this configuration, it is possible to reliably prevent that the degree of the permeation of the ink for forming the flushing dot into the sheet P is reduced, thereby making it possible to restrain the flushing dot from being conspicuous.

Further, in the above-described embodiment, the present invention is applied to the line-type printer including the heads 1 elongated in the main scanning direction, but may be applied to a serial-type printer including heads movable in the main scanning direction.

What is claimed is:

1. A liquid ejection apparatus comprising:

a feeding mechanism configured to feed a recording medium in a feeding direction;

a first ejection head having a first liquid-ejection opening through which is ejected first liquid that is for forming an image on the recording medium;

a second ejection head having a second liquid-ejection opening through which is ejected second liquid that is liquid to be ejected on the recording medium to reduce a degree of absorption of the first liquid into the recording medium;

an image-data storage section configured to store image data of the image to be recorded on the recording medium;

an image-recording controlling section configured to control the first ejection head on the basis of the image data stored in the image-data storage section such that an image dot is to be formed on the recording medium by the first liquid ejected from the first liquid-ejection opening of the first ejection head and landed on the recording medium;

a flushing-operation-data producing section configured to produce flushing-operation data for a flushing operation of the first liquid;

a flushing-operation controlling section configured to control the first ejection head on the basis of the flushing operation data produced by the flushing-operation-data producing section such that the flushing dot is to be formed on the recording medium by the first liquid ejected from the first liquid-ejection opening of the first ejection head and landed on the recording medium;

a second-liquid-ejection-data producing section configured to produce data about the ejection of the second liquid such that (i) the second liquid is to be landed on at least one dot area on which the first liquid is to be landed on the basis of the control of the image-recording controlling section among a plurality of dot areas into which the recording medium is partitioned and each of which has a first length corresponding to a resolution in a direction perpendicular to the feeding direction and a second length corresponding to a resolution in a direction parallel to the feeding direction and (ii) an amount of the second liquid to be landed on at least one dot area on which the first liquid is to be landed on the basis of the control of the flushing-operation controlling section is made smaller, by referring the flushing-operation data produced by the flushing-operation-data producing section, than an amount of the second liquid to be landed on a dot area on which the first liquid is not to be landed on the basis of the control of the flushing-operation controlling section; and a second-liquid controlling section configured to control the second ejection head on the basis of the data produced by the second-liquid-ejection-data producing section.

2. The liquid ejection apparatus according to claim 1, wherein the second-liquid-ejection-data producing section is configured to produce the data about the ejection of the second liquid by referring the flushing-operation data produced by the flushing-operation-data producing section, such that the second liquid is not to be landed on at least one dot area on which the first liquid is to be landed on the basis of the control of the flushing-operation controlling section.

3. The liquid ejection apparatus according to claim 1, wherein the second-liquid-ejection-data producing section is configured to produce, where a dot area on which the image dot is to be formed and a dot area on which the flushing dot is to be formed are adjacent to each other, the data about the ejection of the second liquid by referring the flushing-operation data produced by the flushing-operation-data producing section, such that the second liquid is not to be landed on at least one dot area on which the flushing dot is to be formed.

4. The liquid ejection apparatus according to claim 1, wherein the flushing-operation-data producing section includes a first-liquid temporarily-landed-area determining section configured to temporarily determine a dot area on which the first liquid is to be landed by the flushing operation, as a first-liquid temporarily landed area on the basis of the image data stored in the image-data storage section, and wherein the second-liquid-ejection-data producing section is configured to produce the data about the ejection of the second liquid by referring the first-liquid temporarily landed area.

5. The liquid ejection apparatus according to claim 4, wherein the second-liquid-ejection-data producing section includes:

a second-liquid temporarily-landed-area determining section configured to temporarily determine dot areas on which the second liquid is to be landed, as second-liquid temporarily landed areas on the basis of the image data stored in the image-data storage section;

a judging section configured to judge whether at least one of the second-liquid temporarily landed areas overlaps with the first-liquid temporarily landed area temporarily determined by the first-liquid temporarily-landed-area determining section or not; and a first-liquid-landed-area determining section configured to determine, where the judging section has judged that at least one of the second-liquid temporarily landed areas overlaps with the first-liquid temporarily landed area, a dot area on which the first liquid is to be landed by the flushing operation so as not to overlap with the first-liquid temporarily landed area, as a first-liquid landed area.

6. The liquid ejection apparatus according to claim 1, wherein the second liquid is liquid which reduces a degree of permeation of the first liquid into the recording medium, wherein the second ejection head is disposed on an upstream side of the first ejection head in the feeding direction in which the recording medium is fed when the image dot is formed by the first ejection head, and wherein at least one of the plurality of dot areas on which the first liquid ejected by the first ejection head is to be landed is a dot area on which the second liquid ejected from the second liquid-ejection opening is to be landed before the first liquid is landed on the at least one of the plurality of dot areas.

7. The liquid ejection apparatus according to claim 1, wherein the second liquid is liquid which improves solidification of the first liquid on the recording medium, wherein the second ejection head is disposed on a downstream side of the first ejection head in the feeding direction in which the recording medium is fed when the image dot is formed by the first ejection head, and wherein at least one of the plurality of dot areas on which the first liquid ejected by the first ejection head is to be landed is a dot area on which the second liquid ejected from the second liquid-ejection opening is to be landed after the first liquid is landed on the at least one of the plurality of dot areas.

8. The liquid ejection apparatus according to claim 1, wherein the second-liquid-ejection-data producing section is configured to produce the data about the ejection of the second liquid such that the second liquid is not to be landed on any one of the dot areas on which the first liquid is to be landed on the basis of the control of the flushing-operation controlling section.

9. The liquid ejection apparatus according to claim 1, wherein a plurality of first ejection heads each as the first ejection head are provided, and wherein the flushing-operation-data producing section is configured to produce the flushing-operation data for the first liquid such that the first liquid ejected by one of the plurality of first ejection heads in the flushing operation is to be landed on at least one of the plurality of dot areas on which the first liquid ejected by another of the plurality of first ejection heads on the basis of the control of the image-recording controlling section is to be landed.

10. The liquid ejection apparatus according to claim 1, wherein the second-liquid-ejection-data producing section is configured to produce the data about the ejection of the second liquid such that, where the dot area on which the image dot is to be formed and the dot area on which the flushing dot is to be formed are adjacent to each other, an amount of the second liquid to be landed on said dot area on which the image dot is to be formed is made smaller than in a case where the dot areas are not adjacent to each other.

11. The liquid ejection apparatus according to claim 10, further comprising a brightness judging section configured to judge a high and low relationship in brightness between two dots formed on the recording medium and a difference in brightness between the two dots, wherein the second-liquid-ejection-data producing section is configured to produce the data about the ejection of the second liquid such that, where the dot area on which the image dot is to be formed and the dot area on which the flushing dot is to be formed are adjacent to each other, and the brightness judging section has judged that the image dot is higher in brightness than the flushing dot, the amount of the second liquid to be landed on the dot area on which the image dot is to be formed is made smaller in a case where a difference in brightness between said image dot and the flushing dot is large than in a case where the difference in brightness between the image dot and the flushing dot is small.

12. The liquid ejection apparatus according to claim 11, wherein the second-liquid-ejection-data producing section is configured to produce the data about the ejection of the second liquid such that, where the dot area on which the image dot is to be formed and the dot area on which the flushing dot is to be formed are adjacent to each other, and the brightness judging section has judged that the image dot is higher in brightness than the flushing dot, the larger the difference in brightness between the image dot and the flushing dot is, the smaller amount of the second liquid is to be landed on the dot area on which the image dot is to be formed.

13. The liquid ejection apparatus according to claim 11, wherein a plurality of first ejection heads each as the first ejection head are provided respectively corresponding to a plurality of colors of the first liquid which are different from each other, wherein the liquid ejection apparatus further comprises a brightness calculating section configured to calculate brightness of a dot to be formed on the recording medium on the basis of a color and an amount of the first liquid to be ejected by the first ejection head, and wherein the brightness judging section is configured to judge the high and low relationship in brightness between the two dots and the difference in brightness between the two dots on the basis of a result of the calculation of the brightness calculating section.

14. The liquid ejection apparatus according to claim 1, wherein the second-liquid-ejection-data producing section is configured to produce the data about the ejection of the second liquid such that, where the dot area on which the image dot is to be formed and the dot area on which the flushing dot is to be formed are adjacent to each other, the second liquid is to be landed on a position further from the dot area on which the flushing dot is to be formed than in the case where the dot areas are not adjacent to each other.

15. The liquid ejection apparatus according to claim 14, further comprising a brightness judging section configured to judge a high and low relationship in brightness between two dots formed on the recording medium and a difference in brightness between the two dots, wherein the second-liquid-ejection-data producing section is configured to produce the data about the ejection of the second liquid such that, where the dot area on which the image dot is to be formed and the dot area on which the flushing dot is to be formed are adjacent to each other, and the brightness judging section has judged that the image dot is higher in brightness than the flushing dot, the second liquid is to be landed on a position further from the dot area on which the image dot is to be formed in a case where a difference in brightness between the image dot and the flushing dot is large than in a case where the difference in brightness between the image dot and the flushing dot is small.

16. The liquid ejection apparatus according to claim 15, wherein the second-liquid-ejection-data producing section is configured to produce the data about the ejection of the second liquid such that, where the dot area on which the image dot is to be formed and the dot area on which the flushing dot is to be formed are adjacent to each other, and the brightness judging section has judged that the image dot is higher in brightness than the flushing dot, the larger the difference in brightness between the image dot and the flushing dot is, the further position from the dot area on which the image dot is to be formed the second liquid is to be landed on.

17. The liquid ejection apparatus according to claim 1, further comprising a two-side recording mechanism configured to record images respectively on both faces of the recording medium, wherein the flushing-operation-data producing section is configured to produce the flushing-operation data for the first liquid such that dot areas on which the first liquid to be ejected in the flushing operation do not overlap with each other on the both faces of the recording medium.

18. The liquid ejection apparatus according to claim 1, further comprising a liquid-amount calculating section configured to split the recording medium into a plurality of blocks each constituted by ones of the plurality of dot areas and configured to calculate, for each of the plurality of blocks, a total amount of the first liquid to be ejected by the first ejection head on the basis of the control of the image-recording controlling section and landed on the recording medium, wherein the second-liquid-ejection-data producing section is configured to produce the data about the ejection of the second liquid on the basis of a result of the calculation of the liquid-amount calculating section such that, where the total amount of the first liquid to be landed on one of the plurality of blocks is small, a total amount of the second liquid to be landed on the block is made smaller than in a case where the total amount of the first liquid to be landed on the block is large, and wherein the flushing-operation-data producing section is configured to change a position on which the first liquid is to be landed, such that, where a less liquid block in which the total amount of the first liquid calculated by the liquid-amount calculating section is smaller than that in a to-be-landed block that includes a dot area on which the first liquid ejected in the flushing operation is to be landed is present among the plurality of blocks at a position located on a downstream side of the to-be-landed block in the feeding direction in which the recording medium is fed when the image dot is formed by the first ejection head, the first liquid ejected in the flushing operation is to be landed on the less liquid block.

19. The liquid ejection apparatus according to claim 1, further comprising:

a second-liquid flushing-operation-data producing section configured to produce data for a flushing operation of the second liquid such that the second liquid is not to be landed on a dot area on which the first liquid is to be landed on the basis of the control of the flushing-operation controlling section, among the plurality of dot areas; and a second-liquid flushing-operation controlling section configured to control the second ejection head on the basis of the flushing-operation data for the second liquid produced by the second-liquid flushing-operation-data producing section such that the flushing operation using the second liquid is performed on the recording medium on which the image is to be recorded.

20. The liquid ejection apparatus according to claim 1, further comprising:

a first vibration controlling section configured to control the first ejection head such that an energy is applied to the first liquid for vibrating a meniscus of the first liquid which is formed near the first liquid-ejection opening not used for the ejection; and a second vibration controlling section configured to control the second ejection head such that an energy is applied to the second liquid for vibrating a meniscus of the second liquid which is formed near the second liquid-ejection opening not used for the ejection.

21. The liquid ejection apparatus according to claim 1, wherein the first ejection head is a head of line type elongated in a direction perpendicular to the feeding direction.

22. A non-transitory storage medium storing a program used for a liquid ejection apparatus, the liquid ejection apparatus comprising:

a feeding mechanism configured to feed a recording medium in a feeding direction;

a first ejection head having a first liquid-ejection opening through which is ejected first liquid that is for forming an image on the recording medium;

a second ejection head having a second liquid-ejection opening through which is ejected second liquid that is liquid to be ejected on the recording medium to reduce a degree of absorption of the first liquid into the recording medium; and an image-data storage section configured to store image data of the image to be recorded on the recording medium, wherein the program comprises:

controlling the first ejection head on the basis of the image data stored in the image-data storage section such that an image dot is to be formed on the recording medium by the first liquid ejected from the first liquid-ejection opening of the first ejection head and landed on the recording medium;

producing flushing-operation data based on which a flushing operation of the first liquid;

producing data about the ejection of the second liquid such that (i) the second liquid is to be landed on at least one dot area on which the first liquid is to be landed on the basis of the image data among a plurality of dot areas into which the recording medium is partitioned and each of which has a first length corresponding to a resolution in a direction perpendicular to the feeding direction and a second length corresponding to a resolution in a direction parallel to the feeding direction and (ii) an amount of the second liquid to be landed on at least one dot area on which the first liquid is to be landed on the basis of the flushing-operation data is made smaller, by referring the produced flushing-operation data, than an amount of the second liquid to be landed on a dot area on which the first liquid is not to be landed on the basis of the flushing-operation data;

controlling the first ejection head on the basis of the produced flushing-operation data such that the flushing dot is to be formed on the recording medium by the first liquid ejected from the first liquid-ejection opening of the first ejection head and landed on the recording medium; and controlling the second ejection head on the basis of the produced data about the ejection of the second liquid.

* * * * *